United States Patent [19]

Cornell

[11] 4,403,748

[45] Sep. 13, 1983

[54] DISPENSER FOR COILED MATERIAL HAVING IMPROVED TRANSFER MECHANISM

[75] Inventor: Robert W. Cornell, Milwaukee, Wis.

[73] Assignee: Griffith-Hope Company, Milwaukee, Wis.

[21] Appl. No.: 296,816

[22] Filed: Aug. 27, 1981

[51] Int. Cl.[3] ..... B65H 19/00

[52] U.S. Cl. ..... 242/55.53; 226/129

[58] Field of Search ..... 242/55.3, 55.53; 226/129; 312/37–41

[56] References Cited

U.S. PATENT DOCUMENTS

| | | | |
|---|---|---|---|
| 3,628,743 | 12/1971 | Bastian et al. | 242/55.3 |
| 3,917,191 | 11/1975 | Graham, Jr. et al. | 242/55.3 |
| 4,106,684 | 8/1978 | Hartbauer et al. | 226/91 |
| 4,165,138 | 8/1979 | Hedge et al. | 312/39 |

*Primary Examiner*—Leonard D. Christian

*Attorney, Agent, or Firm*—Andrus, Sceales, Starke & Sawall

[57] ABSTRACT

A dispenser for coiled sheet material, such as paper towelling, having an improved transfer mechanism for transferring feed from a partially consumed roll of sheet material to a fresh or reserve roll. The partially used roll is disposed within a cradle in the lower portion of the cabinet and the free end of the sheet material is fed upwardly over a control arm and then through cooperating feed rolls to a discharge opening. The control arm is mounted on a transfer frame that is pivotally connected to the cabinet, and a transfer arm is also mounted on the forward portion of the transfer frame above the feed rolls. As the partially used roll is consumed, the control arm will move downwardly thereby pivoting the frame and moving the transfer arm toward the feed rolls to insert the free end of the fresh roll into the nip between the feed rolls so that the sheet from the reserve roll will then be fed from the dispenser.

15 Claims, 13 Drawing Figures

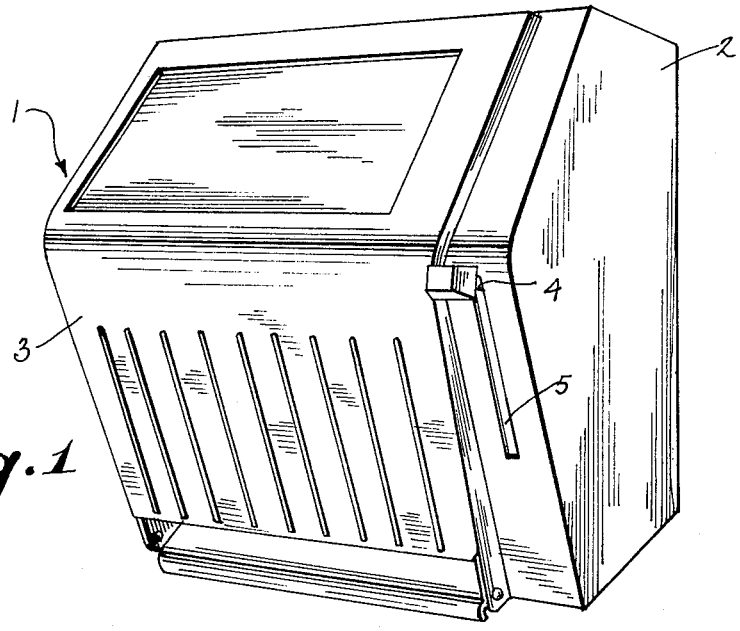
Fig. 1
Fig. 2
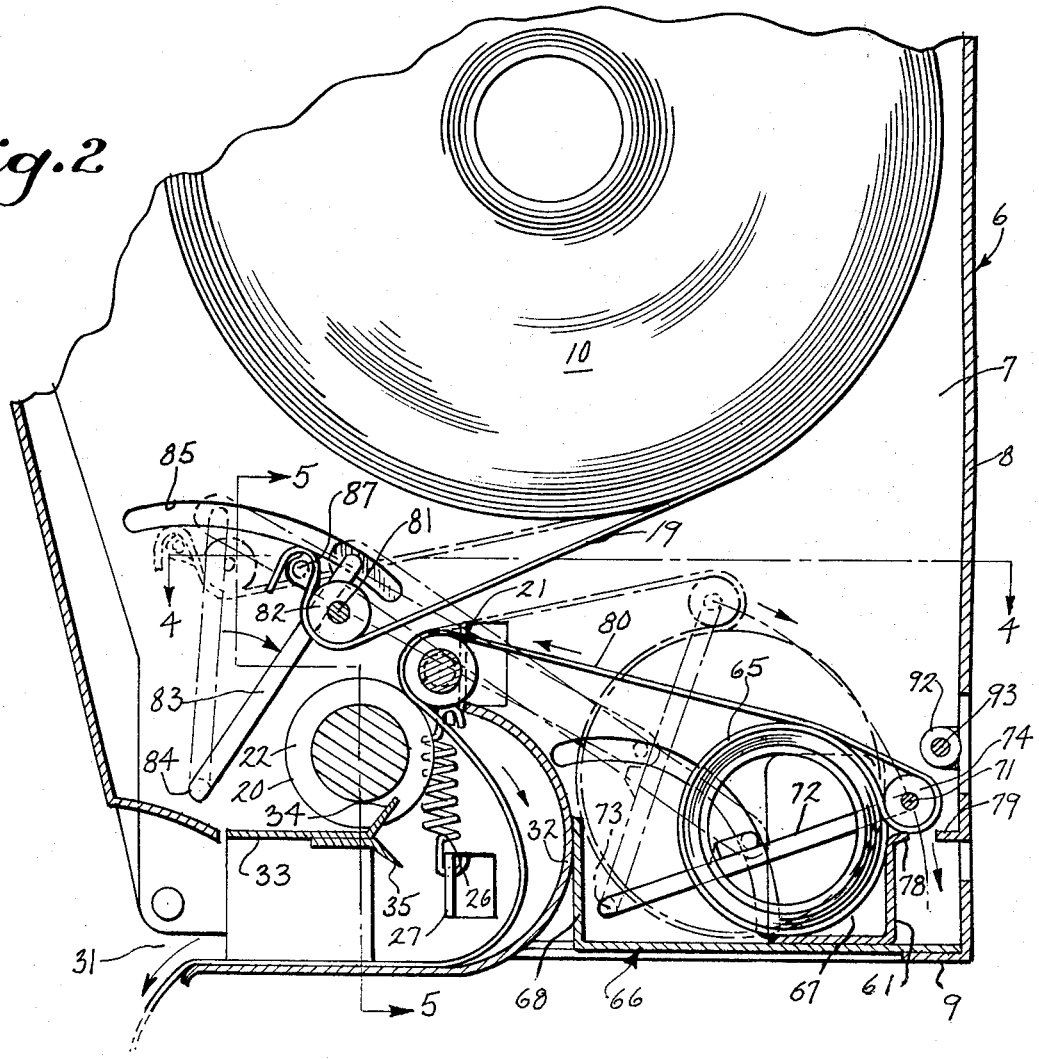

Fig. 3
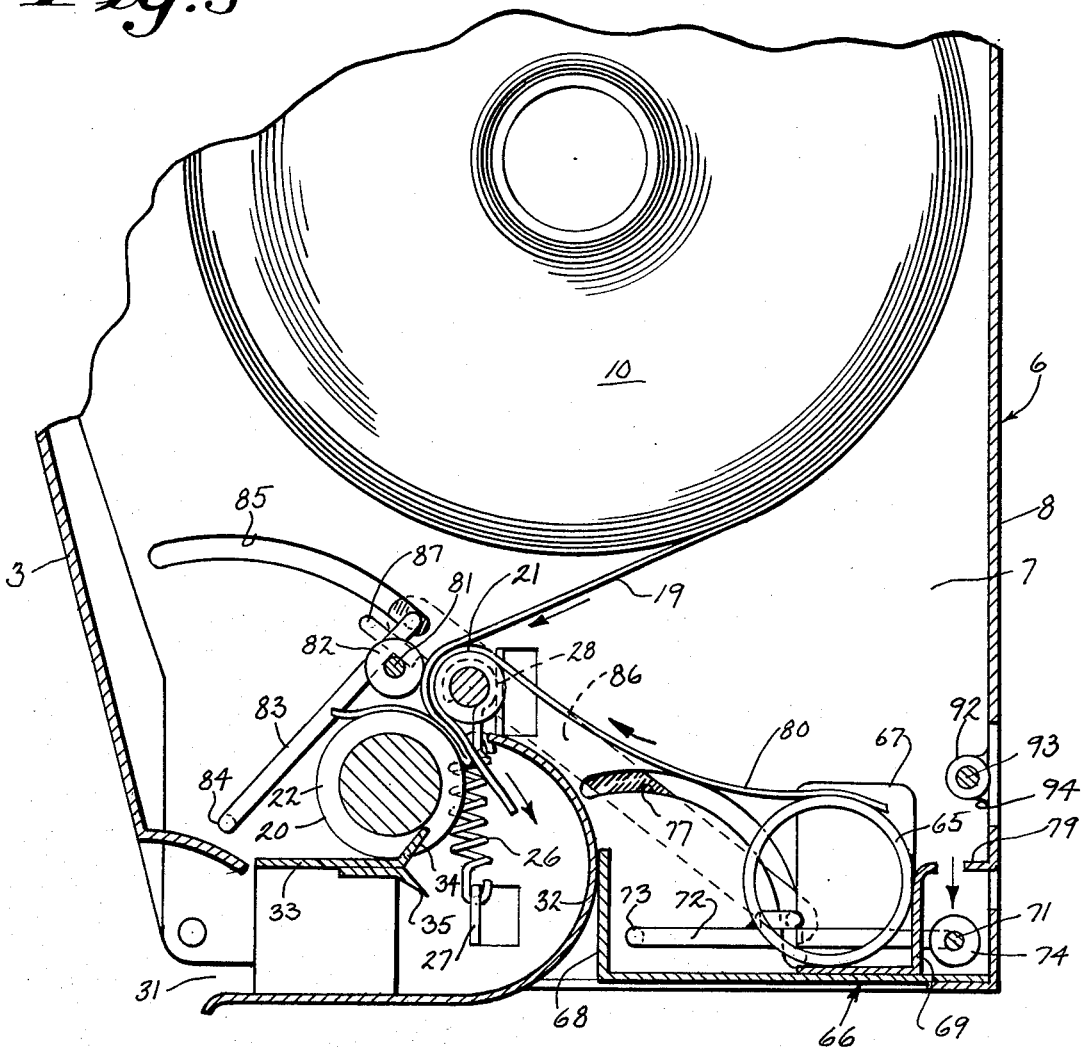
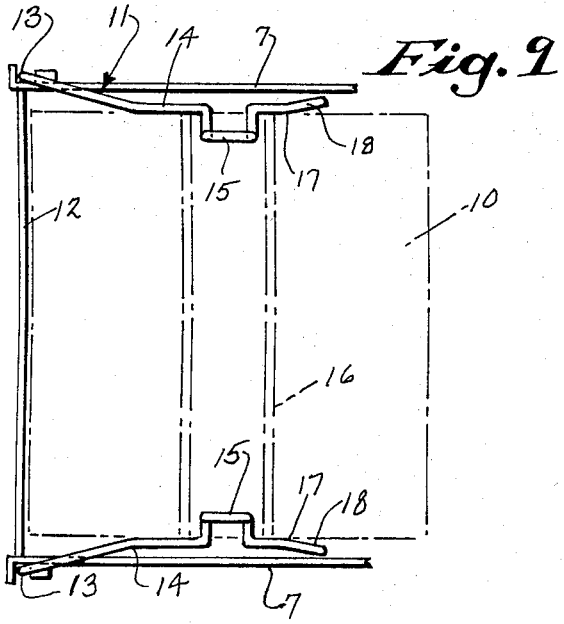
Fig. 9
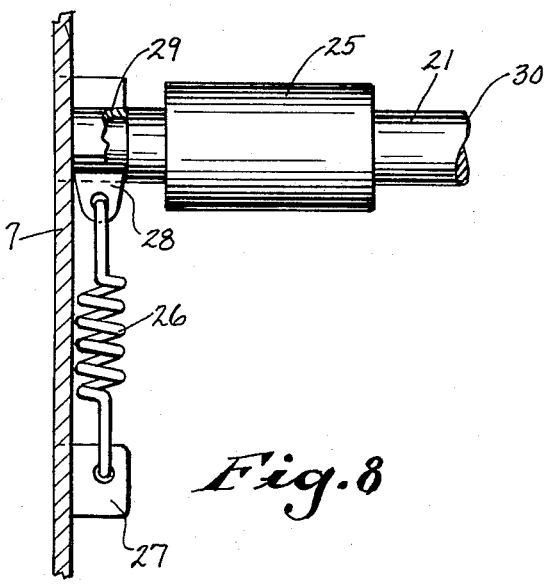
Fig. 8

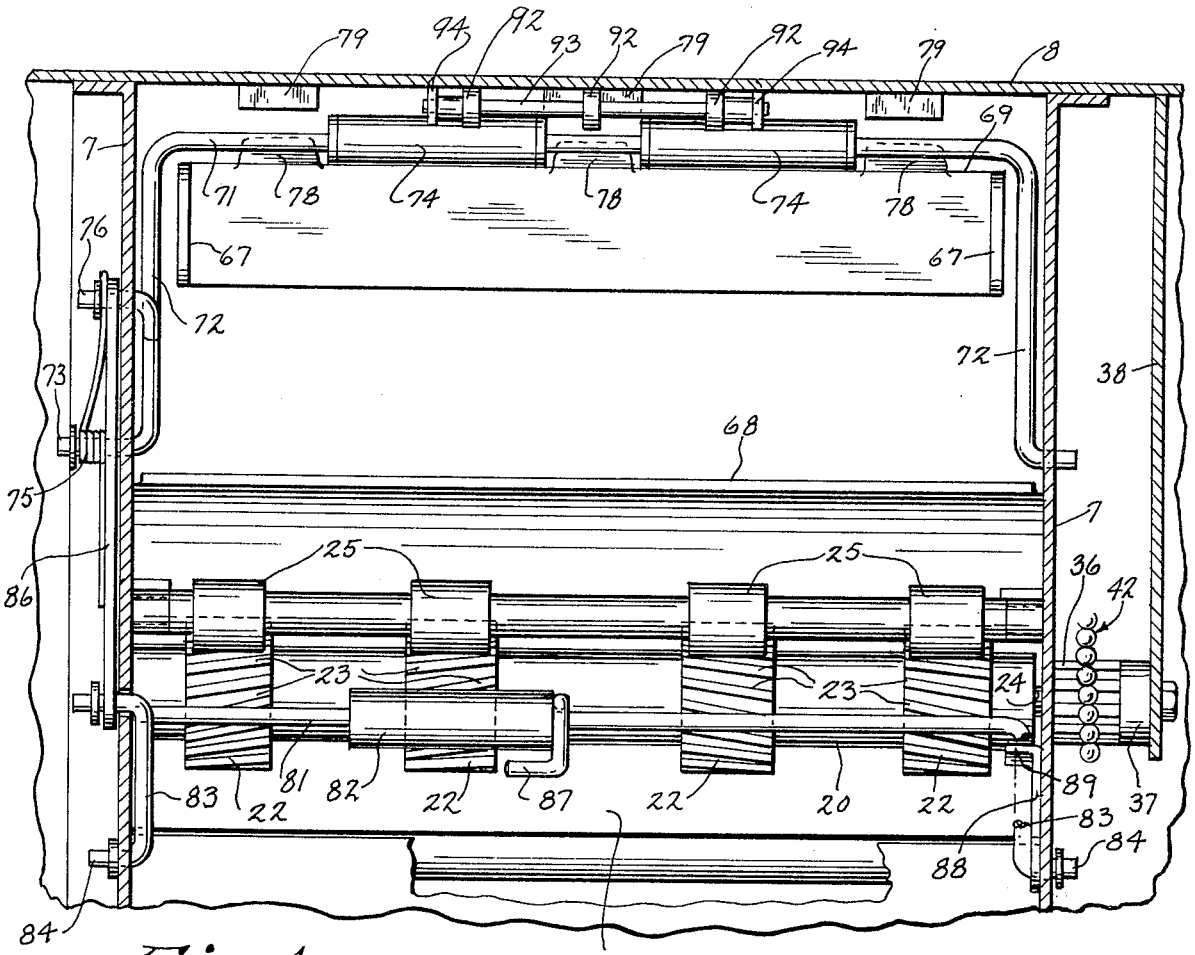
Fig. 4
Fig. 5
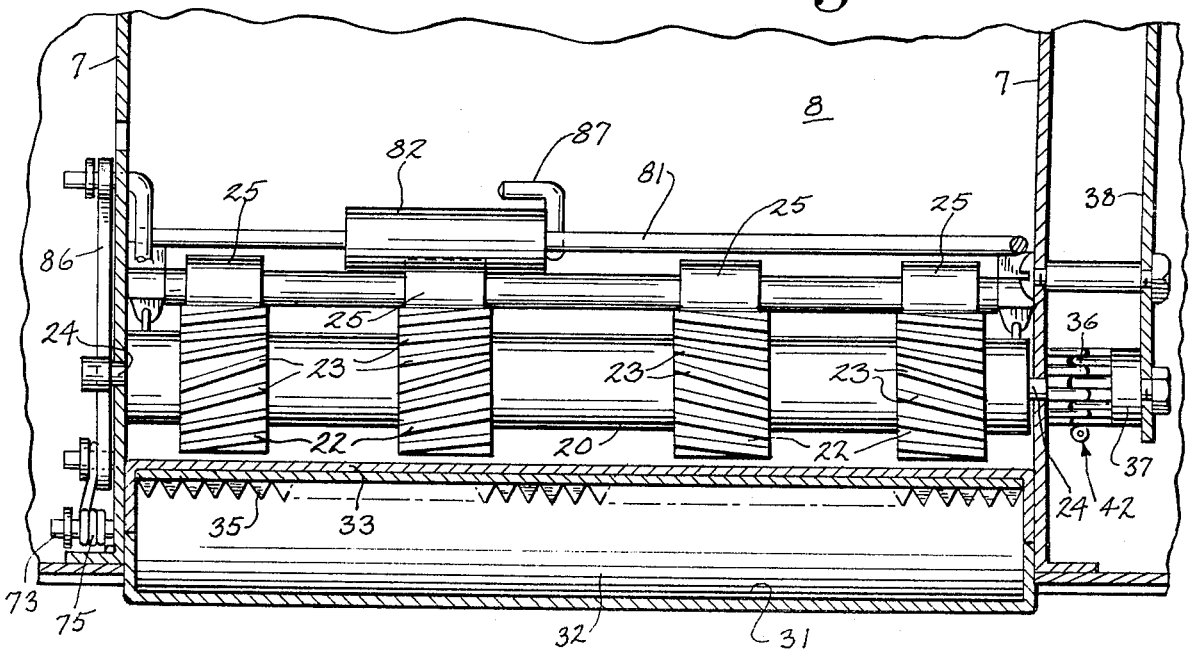

Fig. 6
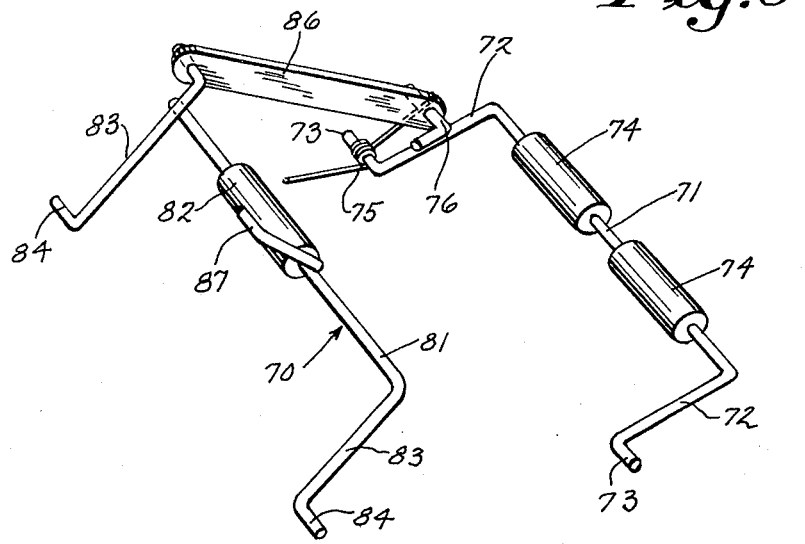
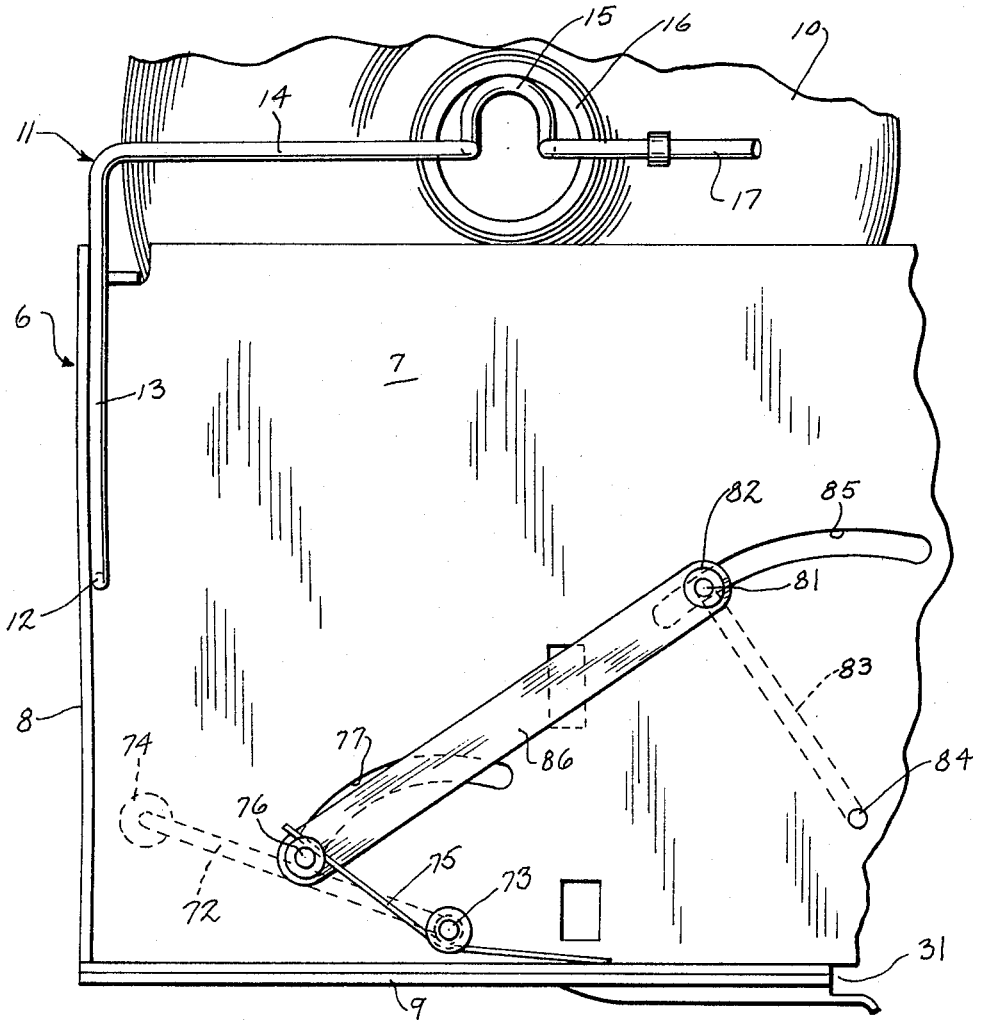
Fig. 7

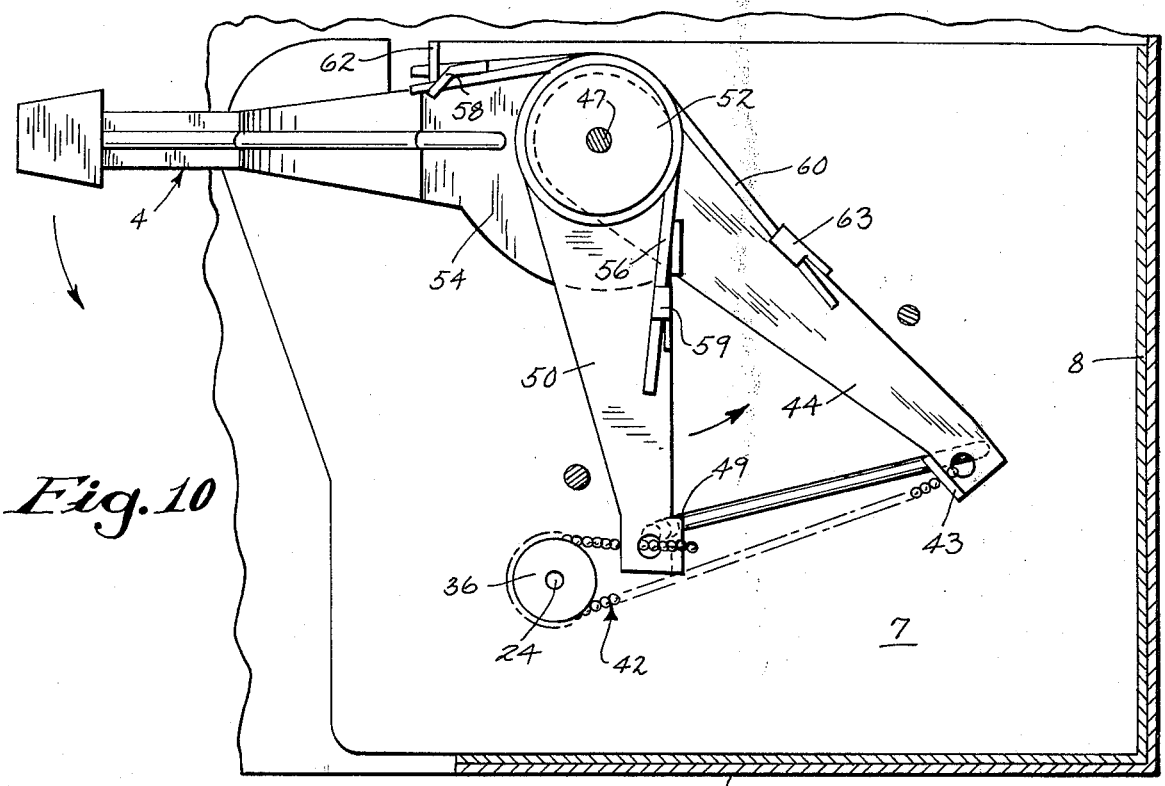
Fig. 10
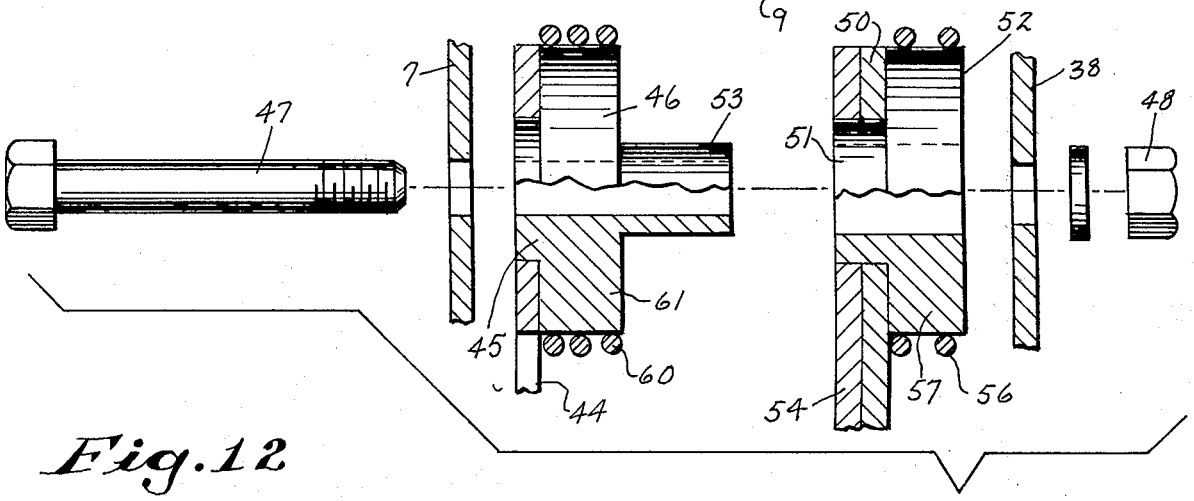
Fig. 11
Fig. 12
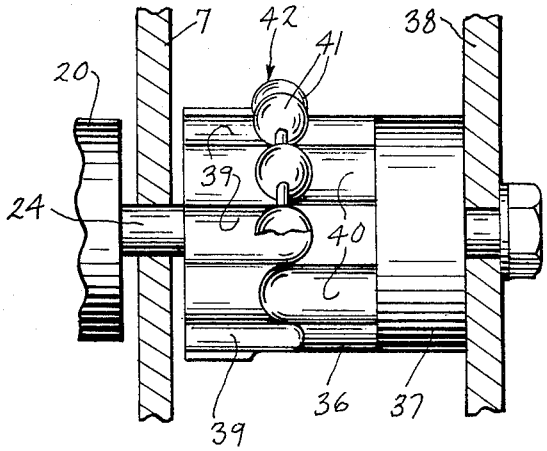
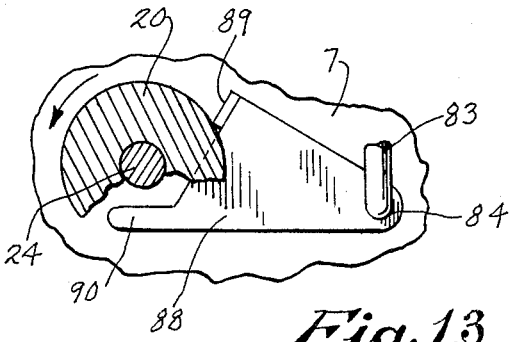
Fig. 13

DISPENSER FOR COILED MATERIAL HAVING IMPROVED TRANSFER MECHANISM

BACKGROUND OF THE INVENTION

Paper towel dispensers contain a roll of paper towelling which is fed from the dispenser through a discharge opening by operation of a pair of cooperating feed rolls. In the conventional dispenser, the feed rolls are operated by manual movement of a crank or lever on the side of the dispenser.

Recently dispensers have incorporated a provision for automatically transferring feed from a partially consumed roll to a fresh or reserve roll. In dispensers of this type, as shown in U.S. Pat. Nos. 4,106,684, 4,165,138 and 3,628,743, the partially consumed roll is mounted in a cradle in the lower portion of the dispenser and the sheet is fed through cooperating feed rolls to the discharge opening. A fresh or reserve roll is mounted in a cradle above the partially consumed roll, and the free end of the sheet of the fresh roll is normally draped above the feed rolls. In dispensers of this type, a transfer mechanism is utilized which will automatically transfer feed to the reserve roll when the partially consumed roll is fully depleted. In some cases the transfer mechanism senses the diameter of the partially consumed roll and will transfer the feed when the diameter has been reduced to a predetermined value. In other transfer mechanisms, such as shown in U.S. Pat. No. 4,165,138, a sensing finger rides on the sheet being dispensed from the partially consumed roll and senses the end of the sheet. When the end of the sheet is drawn beyond the sensing finger, the finger will drop into a groove in one of the feed rolls to actuate a transfer finger which moves the free end of the sheet of the reserve roll into the nip between the feed rolls, so that the reserve roll is then fed by the feed rolls.

SUMMARY OF THE INVENTION

The invention is directed to a dispenser for sheet material, such as paper towelling, which has an improved transfer mechanism for transferring feed from a partially consumed stub roll to a fresh or reserve roll.

The partially consumed stub roll is disposed within a cradle located in the lower portion of the cabinet, and the free end of the stub roll is fed upwardly over a control arm, which is mounted on a transfer frame, and then through cooperating feed rolls to the discharge opening of the dispenser.

Mounted on the forward portion of the transfer frame is a transfer arm which is located above the cooperating feed rolls. The fresh or reserve roll is supported in a wire form support in the upper end of the cabinet of the dispenser and the free end of the fresh roll is engaged with a hook on the transfer arm.

As the stub roll is consumed, the control arm will descend, thereby pivoting the frame toward the rear and moving the transfer arm toward the feed rolls. When the stub roll has been fully consumed, the control arm, which is then unsupported by the sheet, will fall to the bottom of the cabinet and the frame will be pivoted to the rear, bringing the free end of the fresh roll into the nip between the feed rolls. As the feed rolls are operated through use of the hand lever, the reserve roll will then be fed through the discharge opening in the dispenser.

The mechanism of the invention provides a more positive transfer of feed from the stub roll to the reserve roll. As the end of the sheet of the reserve roll is engaged with a hook on the transfer arm, the possibility of the reserve sheet being accidentally and prematurely fed to the feed rolls is eliminated.

Loading or installation of the stub roll is also facilitated. To load the stub roll, the transfer frame is merely pivoted forwardly and the stub roll dropped into the supporting cradle.

The pressure roll, which cooperates with the driven feed roll to feed the sheet from the dispenser, is biased downwardly in the direction of pull on the paper sheet and this eliminates the possibility of the paper sheet slipping as it is being torn by the consumer.

The invention also includes a brake mechanism which is associated with the feed roll to prevent reverse rotation of the feed roll. The brake, which is pivotally connected to the cabinet, rides against the surface of the feed roll and is constructed so that it will permit free rotation of the feed roll in the feeding direction but will prevent reverse rotation, to thereby prevent the paper sheet from being pulled back into the dispenser on release of the operating handle.

The invention also includes a series of anit-climbing rollers which are mounted on the rear wall of the cabinet and prevent the stub roll from creeping upwardly out of its supporting cradle during operation of the dispensing mechanism.

In the construction of the invention, the feed roll is provided with a series of spaced resilient collars, each of which is provided with a plurality of diagonal or herringbone ribs. The herringbone ribs serve to center the sheet of towelling and stretch the sheet laterally to remove wrinkles from the sheet as it is being dispensed.

Other object and advantages will appear in the course of the following description.

DESCRIPTION OF THE DRAWINGS

The drawings illustrate the best mode presently contemplated of carrying out the invention.

In the drawings:

FIG. 1 is a perspective view of the cabinet of the dispenser;

FIG. 2 is a vertical section of the dispenser showing the partially consumed roll being dispensed;

FIG. 3 is a view similar to FIG. 2 showing completion of dispensing of the partially consumed roll and the transfer feed to the fresh roll;

FIG. 4 is a horizontal section showing the support for the stub roll and the feed rolls;

FIG. 5 is a vertical section showing the feed rolls and blade;

FIG. 6 is a perspective view of the transfer frame;

FIG. 7 is a fragmentary side view of the inner housing and showing the support for the reserve roll and the transfer frame;

FIG. 8 is a fragmentary enlarged vertical section showing the connection of the pressure roll to the frame;

FIG. 9 is a top view of the wire form support for the reserve roll;

FIG. 10 is a side elevation of the operating lever feed mechanism;

FIG. 11 is an exploded view of the shaft construction for the operating lever mechanism;

FIG. 12 is an enlarged vertical section showing the bead chain and sprocket drive for the feed rolls; and FIG. 13 is an enlarged vertical section of the brake mechanism for preventing reverse rotation of the feed roll.

DESCRIPTION OF THE PREFERRED EMBODIMENT

FIG. 1 illustrates a dispenser 1 for a rolled product, such as paper towelling, toilet tissue, or the like, which includes an outer cabinet or housing 2 and a front cover 3 which is hinged along its lower edge to the cabinet 2. An operating lever 4 extends outwardly through a slot 5 in the cover, and by pushing downwardly on the lever, a predetermined length of the towelling or other sheet material, will be dispensed from the dispenser 1.

Located within the cabinet 1 is a frame 6 which is composed of a pair of generally vertical side walls 7, a rear wall 8 and a bottom wall 9.

A fresh or reserve roll 10 of towelling is supported by a wire form support 11 in the upper end of the cabinet 1. The wire form support includes a lower horizontal section 12 which extends transversely between the side walls 7, and vertical sections 13 extending upwardly from lower section 12. Upper sections 14 extend forwardly from each vertical section 13 and the central portion of each upper section 14 is provided with an inwardly extending projection 15 which is inserted within the core 16 of the roll 10, as best shown in FIG. 7, to support the roll for rotation.

As best illustrated in FIG. 9, the forward end of each section 14 is provided with a bend 17 which terminates in a diagonal end section 18.

The bend 17 provides a visual gauge for determining when the roll 10 has been consumed to a point where it is to be transferred to the stub roll compartment. For example, when the outer diameter of the roll 10 approaches the area of the bend 17, the roll 10 is removed and is then used as a stub or partially consumed roll.

The bent ends 18 serve as handles to pull the upper sections 14 outwardly to release the roll 10 and to insert a new reserve roll.

When the sheet 19 of towelling of roll 10 is being dispensed, as shown in FIG. 3, the free end of the sheet 19 passes between a driven feed roll 20 and a pressure roll 21. Rotation of the feed roll 20 will act to draw the sheet from the roll 10.

As best illustrated in FIGS. 5 and 6, the feed roll 20 is provided with a series of resilient collars 22, formed of rubber or the like, which are spaced along the length of the feed roll. Each of the resilient collars 22 is provided with a series of parallel herring-bone ribs 23. As shown in FIG. 6, when viewing the feed roll 20 from the front, the ribs 23 of the collars 22 on the left hand side of the roll are inclined in the opposite direction from the ribs 23 on the right hand collars 22. This herring-bone arrangement serves a dual function in that it acts to stretch the sheet 19 laterally to remove wrinkles from the sheet, and it also centers the sheet on the feed roll.

The shaft 24 of the feed roll 20 is journalled in the side walls 7 of the frame, and one end of the shaft is connected to an operating mechanism, as will be hereinafter described, which serves to rotate the feed roll 20 and thereby dispense a given length of the sheet 19.

The pressure roll 21 is formed with a series of enlargements or collars 25 which are disposed in alignment with the resilient collars 22 on the feed roll 20, and the sheet 19 is fed between the aligned collars 22 and 25.

The pressure roll 21 is biased downwardly into engagement with the feed roll 20 by a spring mechanism, as shown in FIG. 8. The lower ends of extension springs 26 are attached to tabs 27 secured to the side walls 7 and the upper ends of the springs are attached to J-brackets 28 which serve to support bearings 29 that journal the pressure roll shaft 30 for rotation. With this construction, the springs 26 act to urge the pressure roll 21 into engagement with the feed roll, as well as permitting the roll 21 to move relative to the feed roll 20 to accommodate various thicknesses of the sheet being dispensed.

The sheet 19 being fed through the rolls 20 and 21 is discharged from the cabinet through a discharge opening 31 which is defined by a generally curved chute 32, which extends laterally between the side wall 7, and upper plate 33. The upper end of the chute as shown in FIG. 2, terminates adjacent the periphery of the pressure roll 21. Upper plate 33 is spaced beneath the feed roll 20. The plate 33 is provided with a plurality of upstanding curved fingers 34 which extends within the spaces between the resilient collars 22 on the feed roll 20, and the fingers 34 prevent the sheet being dispensed by rolls 20 and 21 from wrapping around the feed roll.

Extending downwardly from the plate 33 is a serrated cutting edge 35. After a length of the sheet 19 has been dispensed through the discharge opening 31 the sheet is pulled outwardly causing the sheet to engage the cutting 35 to sever the sheet.

To rotate the feed roll 20 and dispense the sheet 19, a drive sprocket 36 is connected through a one-way clutch to shaft 24 which in turn is attached to feed roll 20. The shaft 24 also carries a spacer 37 which is mounted between sprocket 36 and outer support plate 38.

The sprocket 36 is formed with a series of longitudinally extending grooves 39 and 40, each of which terminates slightly beyond the longitudinal midpoint of the sprocket. The grooves are staggered, in that one groove 39 will extend from one end of the sprocket slightly beyond the mid-point while the next adjacent groove 40 will extend from the opposite end of the sprocket to a point slightly beyond the midpoint of the sprocket. Beads 41 of a bead chain 42 are received within the ends of the grooves 39 and 40 and as the chain is moved in a path of travel, the sprocket 36 will rotate to correspondingly rotate the feed roll 20. The one-way clutch mechanism associated with the interior of the sprocket 36 enables the sprocket to rotate in one direction, but rotation of the sprocket in the opposite direction will not be transmitted to the feed roll 20.

One end of the bead chain is dead-ended on a tab 43 attached to the lower end of arm 44, and the upper end of the arm 44 is journalled around the reduced diameter section 45 of hub 46. The hub 46 is mounted on a stud 47 which extends between the side wall 7 of the frame and the plate 38. The end of the stud 47 is engaged with a nut 48.

The opposite end of the bead chain 42 is dead-ended on a tab 49 attached to the lower end of an arm 50 that is journalled on the smaller diameter section 51 of collar 52. As best shown in FIG. 11, the hub 46 is provided with an extension 53 which is mounted within an opening in the collar 52.

The inner end 54 of lever 4 is also journalled around the section 51 of collar 52, and the arm 50 and lever 4 are connected by a torsion spring 56, so that downward movement of the lever arm will result in rearward movement of arm 50, as shown by the arrows in FIG.

10. The torsion spring 56 is coiled around the larger diameter portion 57 of collar 52 and one end of the torsion spring is retained by a tab 58 on lever arm 4, while the opposite end of the torsion spring is retained within the tab 59 on the central portion of the arm 50. The torsion spring 56 serves as an over-load mechanism to prevent breakage of the bead chain 42 in the event that the feed roll 20 is jammed and cannot rotate. Under these conditions, in which the feed roll 20 and the arm 50 are immovable, downward pressure on the lever arm 4 will act against the torsion spring 56 to prevent fracture of the chain 42 which is connected to the lower portion of the arm 50.

A biasing mechanism is included which acts to return the lever arm 4 to its original position after being depressed and to move the bead chain 42 to its original position. The biasing mechanism takes the form of a torsion spring 60 which is coiled around the large diameter section 61 of hub 46. One end of torsion spring 60 is connected to a tab 62 which projects laterally from side wall 7, while the opposite end of the torsion spring is retained by a tab 63 mounted on the central portion of the arm 44. The force of the torsion spring 60 will move the arm 44 to the position shown in FIG. 10, and this biasing action will be transmitted through the chain 42 and arm 50 to return the lever 4 to its original generally horizontal position.

The invention includes an improved mechanism for automatically transferring the feed from a partially used stub roll 65 to the full or fresh roll 10. As previously described, the fresh roll 10 is retained in the upper portion of the dispenser and is supported on the wire form support 11. The partially used stub roll 65 is supported in a cradle 66 located in the lower portion of the cabinet 1. The cradle 66 includes a pair of side walls 67, a front wall 68, and a rear wall 69. The stub roll 65 is freely mounted within the cradle.

A transfer assembly is utilized to transfer the feed from the stub roll 65 to the full roll or fresh roll 10. The transfer assembly includes a wire form transfer frame 70, including a transverse central arm 71 and legs 72 are connected to a section 71. The ends of the legs 72 are bent outwardly to provide end sections 73 which are pivotally mounted within the side walls 7. As best illustrated in FIG. 6, a pair of rollers 74 are mounted in spaced relation on the transverse control arm 71 of the frame 70.

The frame 70 is biased downwardly toward the rear by a torsion spring 75. One end of the torsion spring bears against a projection 76, on the corresponding leg 72, which extends through a curved slot 77 in the side wall 7. The other end of the torsion spring 75 bears against the bottom of the cabinet. The force of the torsion spring 75 acts to pivot the frame 70 downwardly to the rear about the pivot points 73.

As illustrated in FIG. 2, the rear wall 69 of the cradle 66 is provided with a series of spaced rearwardly projecting tabs 78, and similarly, the rear wall 8 is provided with a series of forwardly spacing tabs 79 which are located in alignment with tabs 78. The tabs 78 and 79 are spaced apart a sufficient distance to permit the arm 71 to drop downwardly between the aligned tabs, when the stub roll is fully consumed.

As shown in FIG. 2, the stub roll 65 is placed within the cradle 66 and the sheet material 80 from the roll passes beneath the rollers 74 on arms 71 and then passes forwardly and is fed between the feed rollers 20 and 21.

As the sheet material 80 is consumed, the arm 71 will move downwardly to thereby pivot the frame 70 toward the rear of the cabinet.

As shown in FIG. 6, the frame 70 also includes a transversely extending arm 81 on which is mounted a transfer roll 82. Legs 83 are connected to the ends of arm 81 and the ends of the legs are bent, as shown at 84, and pivotally connected to the side walls 7. As shown in FIG. 7, one end of the arm 81 extends through a curved slot 85 in the side wall 7.

The transfer frame 70 also includes a brace 86 which connects the legs 83 and the extension 76.

As previously described, the torsion spring 78 urges the frame 71 in a downward rear direction, and as the sheet 80 of the stub roll 65 is consumed and the diameter of the stub roll decreases, the arm 71 will move downwardly thereby pivoting the frame 70 and moving the transfer arm 81 toward the nip between the feed rolls 20 and 21. When the sheet 80 has been fully consumed, the rollers 74 will be unsupported and the arm 71 will drop downwardly between tabs 78 and 79 to the bottom of the cradle, causing the frame 70 to pivot to the rear and moving the sheet 19 of the reserve roll 10 into the nip between the feed rolls 20 and 21, to thereby feed the sheet 19 through the outlet of the dispenser.

To prevent the free end of the sheet 19 from accidentally being moved into the nip between the feed rolls while the sheet 80 is being fed from the stub roll 65, a hook 87 extends upwardly from the roll 82 and is punctured through the sheet 19. When the sheet 19 is inserted into the nip between the feed rolls by the transfer arm 81, the sheet 19 will be ripped away from the hook 87.

The invention also includes a brake 88 which will prevent reverse rotation of the feed roll 20. Without the brake, the feed roll would tend to return to its original position on release of the operating handle and the paper sheet would be pulled back into the dispenser. One end of the brake 88 is pivotally connected to the side wall 7 through end 84 and the opposite end of the brake is provided with a flange 89 which is adapted to ride against the end of the feed roll 20. The weight of the brake 88 will urge the flange 89 into engagement with the surface of the feed roll. The brake permits free rotation of the feed roll 20 in the feed direction, as shown by the arrow in FIG. 13, but will prevent reverse rotation.

The brake 88 is also provided with an extension 90 which is located beneath the shaft of the feed roll. The extension 90 limits pivotal movement of the brake in a clockwise direction as shown in FIG. 13, to insure that the brake will not accidentally be put into an inoperative position.

It has been found that a sharp blow on the operating handle 4 can pull the stub roll 65 out of the cradle 66 to a position where it could get pinched between the transfer arm 71 and the back surface of the cabinet. In this situation there is enough friction so that the roll 65 could creep up the back wall 8 and cause premature transfer to the fresh roll 10.

To eliminate this possibility, a plurality of rollers 92 are mounted in spaced relation on shaft 93 that is journalled within tabs 94 on the back wall 8. As shown in FIG. 3, the rollers 92 are located at a level above the cradle, and in the event the stub roll 65 moves upwardly it will contact the rollers 92 to prevent the stub roll from creeping up the back wall of the cabinet.

OPERATION

When the full roll 10 has been dispensed to a point where it has a diameter of approximately 3½ inches or less, at which point, the outer diameter will be in proximity to the bends 17, the operator will remove the roll 10 from the wire form support, while retaining the end of the sheet 19 between the rolls 20 and 21.

The transfer frame 70 is then pivoted forwardly and the partially used roll is then inserted into the cradle 66. Transfer frame 70 is then pivoted rearwardly and sheet 80 will pass upwardly around the control arm 71, as shown in FIG. 2. A fresh roll 10 is then inserted in the wire form support 11 and the free end of the sheet 19 is engaged with the hook 87 on the transfer arm 81.

As the stub roll 65 is consumed, the diameter of the stub roll will be decreased and the arm 71 will move downwardly thereby pivoting the frame 70 toward the rear and moving the transfer arm 81, which carries the end of the sheet 19, toward the nip between the rolls 20 and 21. When the sheet 80 of stub roll 65 has been completely drawn from the core of the roll, the control arm 71 will be unsupported and the arm will drop downwardly between tabs 78 and 79 to the bottom of the cradle, thereby causing the frame 70 to pivot to the rear and moving the sheet 19 into the nip between the feed rolls. The remaining end of the sheet 80 will be fed through the discharge opening along with the leading end of the reserve roll 10.

The transfer mechanism of the invention provides a positive transfer of feed from the stub roll 65 to the fresh roll 10 and the use of the hook 87 prevents the accidental feeding of the sheet 19 of the feed roll until the stub roll has been consumed.

The loading of both the stub roll and the fresh roll is facilitated over prior dispensing mechanisms. The stub roll can be loaded by merely pivoting the transfer frame 70 forwardly and dropping the stub roll into the cradle 66, while the fresh roll is loaded by merely inserting the projections 15 on the wire form support 11 into the core of the roll.

Various modes of carrying out the invention are contemplated as being within the scope of the following claims particularly pointing out and distinctly claiming the subject matter which is regarded as the invention.

I claim:

1. A dispenser for coiled sheet material such as paper towelling, comprising a housing having a discharge opening, first support means disposed in the housing to support a first partially consumed roll of first sheet material, second support means disposed within the housing to support a second reserve roll of second sheet material, feed roll means disposed within the housing for feeding a sheet from either of said rolls through said discharge opening, and a transfer mechanism for transferring the feed from the partially consumed roll to the reserve roll, said transfer means comprising a transfer frame pivotally connected to the housing and including a first arm and a second arm, said arms disposed generally parallel to each other and disposed parallel to said feed roll means, said first sheet material extending rearwardly from said partially consumed roll beneath said first arm and then forwardly to said feed roll means, said second arm being spaced from said feed roll means when said first roll is in a partially consumed condition, sheet engaging means on said second arm for engaging the free end of said second sheet material, and biasing means for biasing the frame in a direction to urge said second arm towards said feed roll means, consumption of said partially consumed roll causing the first arm to move downwardly to thereby pivot the frame and move said second arm towards said feed roll means and deliver said second sheet material to said feed roll means to feed the second sheet material from the dispenser.

2. The dispenser of claim 1, wherein said sheet engaging means comprises a hook connected to said second arm to removably engage the free end of said second sheet material.

3. The dispenser of claim 1, wherein said second support means comprises a pair of spaced wire form supports, each support having aligned inwardly extending projections adapted to engage the respective ends of the core of said reserve roll.

4. The dispenser of claim 3, wherein at least one of said supports is provided with a bend adjacent the respective projection which provides a visual gauge to determine the consumption of said reserve roll.

5. The dispenser of claim 3, wherein a portion of at least one of said supports extends outwardly to provide a handle, outward movement of said handle acting to deform the support and permit insertion and removal of the reserve roll.

6. The dispenser of claim 1, wherein said feed roll means comprises a driven feed roll and a pressure roll cooperating with the feed roll, said pressure roll disposed at a level above the feed roll, and second biasing means for urging the pressure roll downwardly into contact with the feed roll.

7. The dispenser of claim 6, wherein at least one of said rolls is provided with a plurality of longitudinally spaced resilient collars.

8. The dispenser of claim 7, wherein said collars are provided with diagonally extending ribs, the ribs associated with the collars on one side of the longitudinal center line of said roll extending in the opposite direction with respect to the ribs associated with the collars on the opposite side of said center line.

9. The dispenser of claim 7, wherein the other of said rolls is provided with a plurality of longitudinally spaced second collars aligned with said first collars.

10. The dispenser of claim 1, wherein said feed roll means comprises a driven feed roll and a pressure roll cooperating with the feed roll, and including unidirectional brake means associated with said feed roll for permitting rotation of the feed roll in the feeding direction and preventing rotation of the feed roll in the opposite direction.

11. The dispenser of claim 10, wherein said brake means is pivotally connected to said housing and includes a brake member disposed to engage said feed roll, and means for urging the brake member into engagement with the feed roll.

12. A dispenser for coiled sheet material such as paper towelling, comprising a housing having a discharge opening, first support means disposed in the rear of the housing to support a first partially consumed roll of first sheet material, second support means disposed within the upper portion of the housing to support a second reserve roll of second sheet material, a pair of cooperating feed rolls disposed within the housing for feeding a sheet from either of said rolls through said discharge opening, and a transfer mechanism for transferring the feed from the partially consumed roll to the reserve roll, said transfer means comprising a transfer frame having a first arm pivotally connected to the housing and a second arm pivotally connected to the housing, said arms disposed generally parallel to each other and disposed generally parallel to the axes of said feed rolls, connecting means for connecting the first and second arms whereby said arms are pivoted in unison, biasing means for biasing the frame in a rearward direction to urge said second arm toward said feed rolls, and said first sheet material extending rearwardly from said partially consumed roll beneath said first arm and then forwardly to said feed rolls, said second arm being spaced from said feed rolls when said first roll is in a partially consumed condition, consumption of said partially consumed roll causing said first arm to move downwardly to thereby pivot the frame rearwardly and move the second arm toward said feed rolls to deliver said second sheet material to said feed rolls and thereby feed the second sheet material from the dispenser, and means located adjacent the discharge opening for severing a length of said sheet material being fed through said discharge opening.

13. The dispenser of claim 12, wherein said first support means comprises a cradle to rotatably support said first roll, and anit-climbing means disposed at a level above the cradle and disposed to prevent the partially consumed roll from climbing the housing as said first sheet material is drawn from said partially consumed roll.

14. The dispenser of claim 13, wherein said anti-climbing means comprises a roller mounted on the rear wall of the housing.

15. The dispenser of claim 12, and including a guide member disposed above the bottom of the first support means, said first sheet material passing over said guide member and beneath said first arm and then forwardly to said feed rolls.

* * * * *

UNITED STATES PATENT AND TRADEMARK OFFICE

CERTIFICATE OF CORRECTION

PATENT NO. : 4,403,748

DATED : September 13, 1983

INVENTOR(S) : Robert W. Cornell

It is certified that error appears in the above-identified patent and that said Letters Patent is hereby corrected as shown below:

Column 2, line 24, "amit" should read -- anti --.

Column 10, line 5, "anit-climbing" should read -- anti-climbing -.

Signed and Sealed this

*Thirty-first* Day of *January 1984*

[SEAL]

*Attest:*

GERALD J. MOSSINGHOFF

*Attesting Officer*

*Commissioner of Patents and Trademarks*